United States Patent [19]

Akashi

[11] Patent Number: 4,995,656

[45] Date of Patent: Feb. 26, 1991

[54] SECURITY SEALING MECHANISM

[75] Inventor: Shunji Akashi, Kurobe, Japan

[73] Assignee: Yoshida Kogyo K. K., Tokyo, Japan

[21] Appl. No.: 441,635

[22] Filed: Nov. 27, 1989

[30] Foreign Application Priority Data

| | | | |
|---|---|---|---|
| Dec. 2, 1988 | [JP] | Japan | 63-157410 |
| May 16, 1989 | [JP] | Japan | 1-56084 |
| Jun. 22, 1989 | [JP] | Japan | 1-73400 |

[51] Int. Cl.[5] ..... E05B 67/38

[52] U.S. Cl. ..... 292/307 R; 70/68

[58] Field of Search ..... 70/68; 292/307 R, 318, 292/319, 322; 24/30.5 W, 30.5 P, 30.5 L, 30.5 R

[56] References Cited

U.S. PATENT DOCUMENTS

| | | | |
|---|---|---|---|
| 3,556,575 | 1/1971 | Farkas | 292/307 R |
| 3,955,842 | 5/1976 | Edwards | 292/307 R |
| 4,001,919 | 1/1977 | Moberg et al. . | |
| 4,008,914 | 2/1977 | Anderson | 70/68 |
| 4,062,090 | 12/1977 | Moolenaars | 292/307 R |
| 4,112,990 | 9/1978 | Anderson | 292/307 R |
| 4,306,745 | 12/1981 | Wenk . | |
| 4,512,599 | 4/1985 | Netto | 292/307 R |
| 4,602,405 | 7/1986 | Sturman | 292/307 R |
| 4,660,874 | 4/1987 | Rifkin | 292/307 R |
| 4,878,702 | 11/1989 | Madsen | 292/307 R |

FOREIGN PATENT DOCUMENTS

| | | |
|---|---|---|
| 472199 | 5/1976 | Australia . |
| 80/02494 | 11/1980 | European Pat. Off. . |
| 4089695 | 9/1983 | European Pat. Off. . |
| 0287060 | 10/1988 | European Pat. Off. . |
| 2324251 | 9/1976 | France . |
| 2352192 | 1/1977 | France . |
| 2372298 | 11/1978 | France . |
| 2115354 | 9/1983 | United Kingdom . |
| 2150207 | 11/1984 | United Kingdom . |

*Primary Examiner*—Robert L. Wolfe

*Attorney, Agent, or Firm*—Hill, Van Santen, Steadman & Simpson

[57] ABSTRACT

A security sealing mechanism for a bag or envelope is mounted on that end of coupling element rows to which a slider comes for closing a slide fastener. The security sealing mechanism comprises a sealing body including an abutting surface disposed at the end thereof contiguous to the coupling element rows for receiving the slider and locking means provided on the upper surface of the sealing body, and a pull tab having one end releasably jointed to the link pivotally connected to the slider and having the other end adapted for unreleasable locking engagement with the locking means.

14 Claims, 7 Drawing Sheets

SECURITY SEALING MECHANISM

BACKGROUND OF THE INVENTION

1. Field of the Invention

The present invention relates to a security sealing mechanism mounted on a slide fastener attached to a bag in which to put valuables when staying in hotels, motels, inns and the like places, and an envelope in which to put confidential letters and inter-office messages and which shuttles between branch offices of a certain organization.

2. Description of Related Art

The present invention has been contrived in consideration of the difficulties encountered by the security sealing mechanism for slide fasteners disclosed in the Applicant's own Japanese Utility Model Application No. 62-155080. As shown in FIG. 10, this security sealing mechanism comprises a sealing body A attached to one end of a slide fastener, which comprises a pair of fastener tapes, two rows of fastener element rows attached to and along the respective inner longitudinal edges of the tapes and a slider C reciprocatively mounted on the fastener element rows and having a pull tab D pivotally mounted thereon, the sealing body A having on its upper side locking means B for unreleasably or permanently locking thereto a tail portion E extending integrally from the pull tab D so that one can easily see from the outside whether his bag carrying the slide fastener still remains sealed safely or it has been subjected to larceny, pilferage or the like in transit.

However, since, in this security sealing mechanism, the pull tab D itself is releasably joined directly to the slider body, the slider C must be equipped with a specific attachment lug of complicated construction, thus rendering the cost of the slider C the more expensive and rendering the manufacture of the slider C and the assemblage of the pull tab D on the slider C more time-consuming and tedeous.

Furthermore, although the tail portion E of the pull tab D is locked to the locking means B, there is no means whatsoever to support the pull tab body D' itself. And, there is frangible thinned portion F between the tail portion E and the pull tab body D'. Consequently, the tail portion E is liable to be broken off the pull tab body D' under lateral stresses exerted on the pull tab body D'.

Still furthermore, the security sealing mechanism can be reused just by replacing the broken pull tab D with new ones D, which are mass-produced for replacement. In these circumstances, some other person is very likely to unseal the bag by breaking the pull tab D and re-seal it by replacing it with a new pull tab D while the bag is in transit. In this event, the addressee of the bag could not tell whether the bag is unsealed or not, so that there is a problem in security with the conventional sealing mechanism.

SUMMARY OF THE INVENTION

With the foregoing drawbacks in view, it is therefore an object of the present invention to provide a security sealing mechanism which enables disposable pull tabs to be easily replaced, even if a commonplace slider is used therewith, thus fully precluding necessity of using a specific slider equipped with a specific attachment lug of complicated construction.

It is another object of the present invention to provide a security sealing mechanism wherein a pull tab body is firmly supported on a sealing body, thus being exempt from the liability of getting broken off a tail portion.

It is still another object of the present invention to provide a security sealing mechanism which enables the addressee of a bag to easily tell whether the bag is unsealed before he receive it.

According to a first aspect of the present invention; there is provided, in a slide fastener comprising a pair of fastener stringers each including a fastener tape and a coupling element row mounted along the inner longitudinal edge thereof and a slider mounted reciprocatively on the coupling element rows, the slider including a slider body having an attachment lug mounted on the upper surface thereof and a link pivotally connected with the attachment lug; a security sealing mechanism comprising a sealing body mounted on that end of coupling element rows to which the slider comes for closing the slide fastener and including an abutting surface disposed at the end thereof contiguous to the coupling element rows for receiving the slider and locking means provided on the upper surface of the sealing body, and a pull tab having one end releasably joined to the link and having the other end adapted for unreleasable locking engagement with the locking means.

According to the second aspect of the present invention, there is provided, in a slide fastener comprising a pair of fastener stringers each including a fastener tape and a coupling element row mounted along the inner longitudinal edge thereof and a slider mounted reciprocatively on the coupling element rows, the slider including a slider body having an attachment lug mounted on the upper surface thereof; a security sealing means comprising a sealing body mounted at that end of coupling element rows to which the slider comes for closing the slide fastener and including abutting surface disposed at the end thereof contiguous to the coupling element rows for receiving the slider and locking means provided on the upper surface of the sealing body, and a pull tab having one end releasably jointed to the attachment lug and having the other end adapted for unreleasable locking engagement with the locking means, the sealing body further including a pair of support walls mounted on the upper surface of the sealing body and disposed in parallel spaced relation to each other to retain the pull tab therebetween.

Many other advantages and features of the present invention will become manifest to those versed in the art upon making reference to the detailed description and the accompanying sheets of drawings in which preferred structural embodiments incorporating the principles of the present invention are shown by way of illustrative example.

BRIEF DESCRIPTION OF THE DRAWINGS

FIG. 7(*b*) is a view similar to FIG. 7(*a*) but shows a still another embodiment;

FIG. 8(*b*) is a view similar to FIG. 7(*a*) but shows still another embodiment;

DETAILED DESCRIPTION

Figure 1:
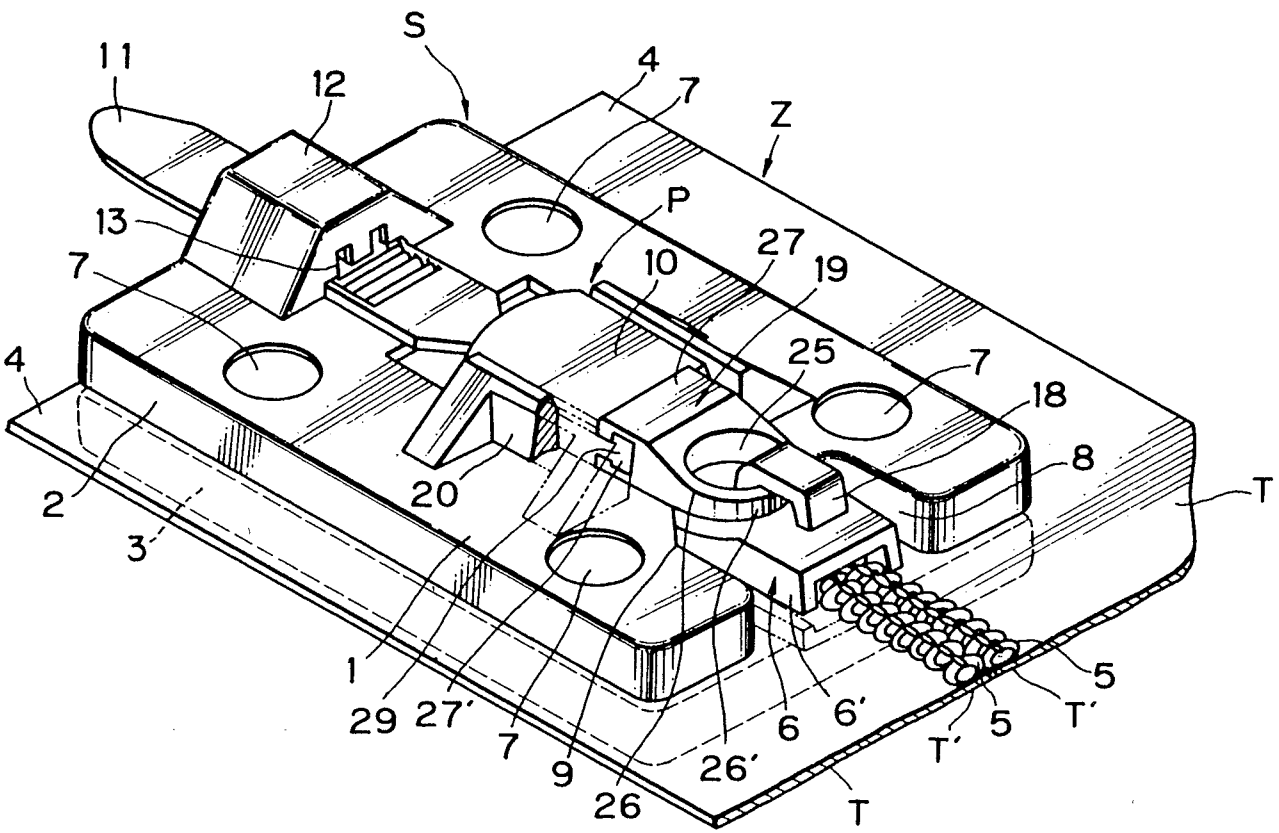
FIG. 1 is an enlarged fragmentary perspective view of a security sealing mechanism according to the present invention.
Figure 9:
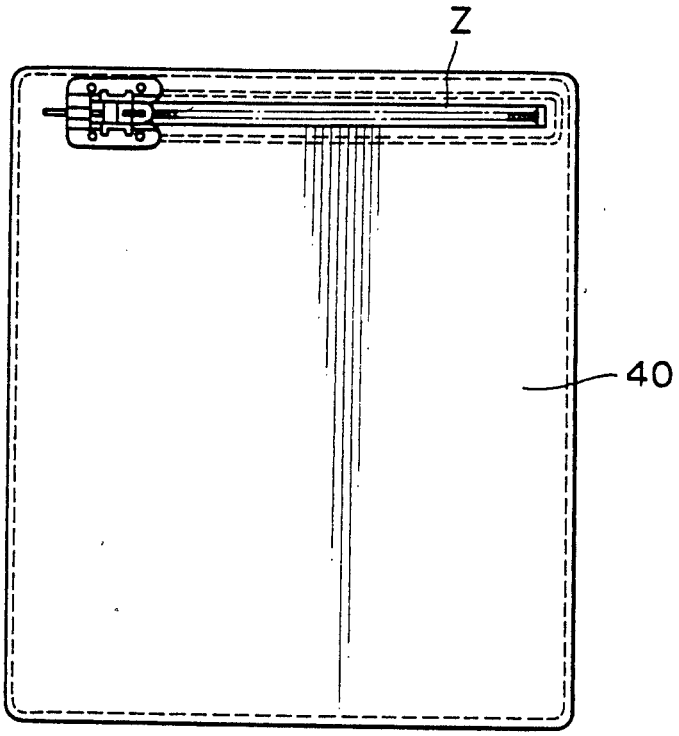
FIG. 9 is a front elevational view of a bag to which the security sealing mechanism according to the present invention is attached.
Figure 10:
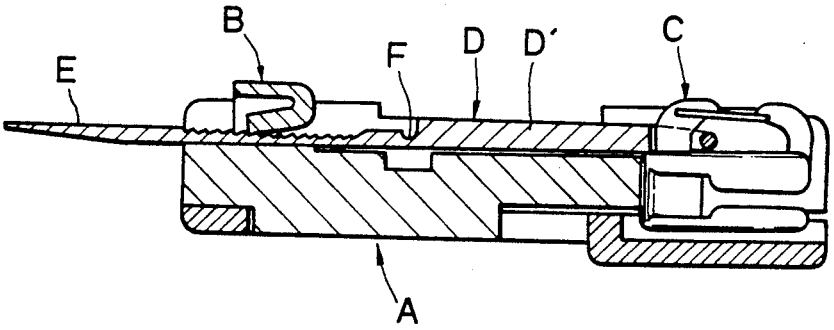
FIG. 10 (RELATED ART)
FIG. 10 is a cross-sectional view of a security sealing mechanism according to the applicant's previous invention.

FIG. 1 shows a security sealing mechanism S according to the present invention being mounted on one end of a slide fastener Z. Since the sealing mechanism S is thus already mounted on the slide fastener Z, it is advantageously very easy to mount on a bag 40, that is, the sealing mechanism S can be mounted on the bag 40 by simply attaching the slide fastener Z to the opening of the bag 40, as shown in FIG. 9. The slide fastener Z comprises a pair of fastener stringers 4, 4 each including a fastener tape T, T and a coupling element row 5, 5 mounted along the inner longitudinal edge T', T' thereof and a slider 6 mounted reciprocatively on and along the coupling element rows 5, 5. The slider 6 comprises a slider body 6' having on its upper surface an attachment lug 18 and a pull tab P pivotally attached to the attachment lug 18 through a link 19 for manipulation of the slider 6, the pull tab P including a pull tab body 10 joined to the link 19 and a tail portion 11 extending integrally therefrom for unreleasably locking engagement with a locking means 12, as closely described hereinbelow.

Figure 2:
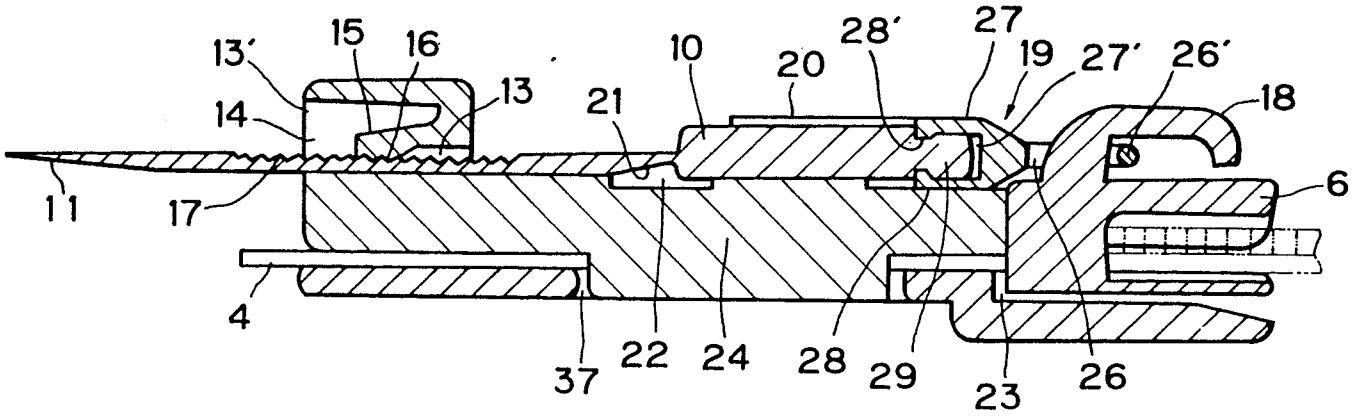
FIG. 2 is a longitudinal cross-sectional view of the security sealing mechanism of FIG. 1.

The security sealing mechanism S is made of synthetic resinous materials and broadly includes a pair of upper and lower rectangular plates 2, 3. The upper and lower plates 2, 3 are attached to that end of the coupling element rows 5, 5 to which the slider 6 comes for fully closing the slide fastener Z, in such a way that the upper and lower plates 2, 3 are joined with each other at their respective four corners by fastening means such as ribets 7, clamping the fastener tapes T, T therebetween, as shown in FIGS. 1 and 2.

The upper plate 2 is substantially rectangular and is recessed at 8 in the end contiguous to fastener element rows 5, 5 to thus provide a concaved abutting surface 9 which is complementary in contour with the front part of the slider 6 for abutting and snug engagement therewith. A locking means 12 is provided protuberantly at the distal end on the upper surface of the upper plate 2 and disposed in alignment with the element rows 5, 5 for the purpose of unreleasably or permanently locking the tail portion 11 of the pull tab P. That end of the sealing body 1 on which the locking means 12 is mounted is referred to the front end, while that end in which the concaved abutting surface 9 is provided the rear end hereinbelow just for convenience's sake. The locking means 12 is in the shape of trapezoidal prism and has a tunnel 14 formed therethrough for inserting the tail portion 11 of the pull tab p. A resilient tongue 15 is provided at the inlet end 13 of the locking means 12 and on the upper edge partly defining the tunnel 14 in such a way to slant downwardly toward the exit end 13' of the locking means 12, as better shown in FIG. 2. The resilient tongue 15 is provided at its distal end and on its lower surface with a series of teeth 16 for locking engagement with a series of prongs 17 provided on the tail portion 11 of the pull tab P when it is inserted through the tunnel 14, as closely described hereinbelow. A pair of support walls 20, 20 are protuberantly mounted substantially centrally on the upper surface of the upper plate 2 and are disposed in parallel spaced relation to each other to thus retain therebetween the link 19 and the pull tab body 10 for preventing them from lateral displacement, when the tail portion 11 of the pull tab P is locked to the locking means 12, so that the security sealing mechanism S can accomplish more reliable sealing effect. A transverse indentation 22 is formed in the upper surface forwardly of the pair of support walls 20, 20 of the upper plate 2 and is disposed in registry with a frangible thinned portion 21 formed between the pull tab body 10 and the tail portion 11, as viewed perpendicularly to the general plane of the sealing body 1, when the tail portion 11 is locked to the locking means 12, so as to thereby facilitate intentional breakage of the frangible thinned portion 21 for unsealing the bag 40.

The lower plate 3 is rectangular as well and substantially identical in contour with the upper plate 2. The lower plate 3 has at its rear end a recess 23 formed therein to allow the slider 6 to stably rest against the bottom thereof when the slider 6 comes into abutting engagement with the concaved abutting surface 9 of the upper plate 2. The lower plate 3 has at its middle a rectangular through hole 37 formed therethrough for fitting engagement with a protuberant boss 24 provided on the lower surface and at the middle of the upper plate 2.

As shown in FIG. 1, the link 19 comprises an annular portion 26 having a circular aperture 25 therein and a coupling portion 27 extending integrally from one end of the annular portion 26. The annular portion 26 has its other end constitute a pivotal portion 26' for pivotal engagement with the attachment lug 18 of the slider 6. The coupling portion 27 is substantially of U-shaped cross-section and includes a pair of parallel spaced coupling flaps 28, 28 defining therebetween a groove 27'. A pair of coupling flanges 28', 28' are provided on and along the respective front edges of the coupling flaps 28, 28 in such a manner to extend toward each other A fitting rim 29 is provided on the proximal edge of the pull tab body 10. The fitting rim 29 is brought into coupling engagement with the coupling flaps 28, 28 by just sliding the fitting rim 29 into and along the groove 27' laterally of the slide fastener Z, thus joining the pull tab P to the link 19 at ease. Since the pull tab P is thus connected to the attachment lug 18 of the slider 6 via the link 19, the slider 6 may be of any commonplace type or it is not necessary to use a special slider equipped with a specific attachment lug of complicated construction, which advantageously render the manufacture of the slider 6 easier, renders the manufacturing cost thereof less costly and assemblage of the pull tab P onto the slider 6 easier.

The pull tab P is disposable and may be made of synthetic resinous materials, hard rubber, metal and the like materials. The pull tab P includes a pull tab body 10 pivotally joined to the link 19, the tail portion 11 adapted for locking engagement with the locking means 12 and a frangible thinned portion 21 disposed between the pull tab body 10 and the link 19, for facilitating the intentional breakage of the pull tab P therebetween. Instead of having a frangible thinned portion 21, the pull tab P may be made less in width between the pull tab body 10 and the tail portion 11 in order to render the intermediate portion frangible. The pull tab body 10 is of such width as to be snugly received between the opposed support walls 20, 20. The pull tab body 10 has at its distal end the fitting rim 29 for fitting engagement with the coupling flaps 28, 28 of the link 19 The tail portion 11 is insertable through the tunnel 14 and has at its middle part on its upper surface a series of prongs 17 for locking engagement with the series of teeth 16 formed on the lower surface of the resilient tongue 15.

As better shown in FIG. 9, the security sealing mechanism S is attached to the opening formed in the bag 40 by sewing, welding or other suitable method.

For sealing the bag 40, the pivotal portion 26 of the link 18 is first joined to the attachment lug 18 of the slider 6 just as a commonplace pull tab is joined thereto. Then, the fitting rim 29 of the pull tab P is slid in and along the groove 27' of the coupling portion 27 of the link 18 laterally of the slide fastener Z, thus being brought into coupling engagement with the coupling portion 27. Thereafter, for closing the slide fastener Z, the pull tab P is pulled to thus move the slider 6 all the way to the sealing mechanism S until the front part of the slider 6 comes into abutting engagement with the concaved abutting surface 9 of the sealing mechanism S. Then, the pull tab P is laid down flat against the upper surface of the upper plate 2 with the tail portion 11 of the pull tab P inserted through the tunnel 14 of the locking means 12, whereupon the series of prongs 17 of the tail portion 11 comes into locking engagement with the series of the teeth 16 of the resilient tongue 15, so that the slider 6 is unreleasably locked to the security sealing mechanism S at great ease. Since the locking means 12 can be seen from the outside, it can be easily confirmed that the sealing is reliably effected, so that the security sealing mechanism S can accomplish increased safe and secure effects as such.

For unsealing the bag 40, the frangible thinned portion 21 is broken, thus releasing the pull tab body 11 from the locked tail portion 11, so that the thus freed slider 6 is slid away from the security sealing mechanism S, thereby opening the slide fastener Z.

Figure 3:
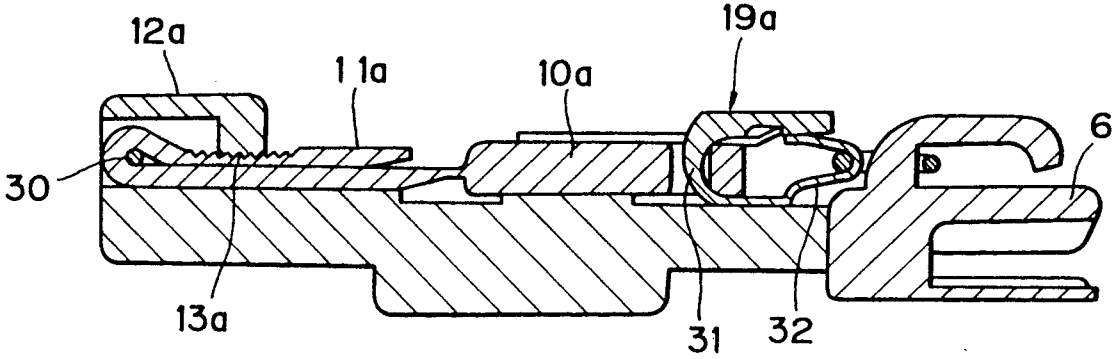
FIG. 3 is a view similar to FIG. 2 but shows another embodiment.

FIG. 3 shows another embodiment of the present invention, which is substantially identical with the preceding embodiment with the following exception. The locking means **12*a* has a transverse bar 30 in a tunnel 14 adjacent to its outlet 13'. The tail portion 11*a* is first inserted through the tunnel 14 beneath the transverse bar 30 and then folded on the transverse bar 30 back over itself and then inserted reversely through the tunnel 14 again. The series of prongs 17 formed on the upper surface of the folded-back portion of the tail portion 11*a* come into locking engagement with the series of teeth 16 of the resilient tongue 15. This construction is intended to ensure that the tail portion 11 be locked to the locking means 12 more retentively Besides, unlike the link 19 according to the other embodiments, the link 19 according to this embodiment comprises a hook-shaped link body 31 hooked with the pull tab P and a resilient plate member 32 resiliently engaged with the link body 31, thus releasably joining the pull tab P with the link 19**.

Figure 4:
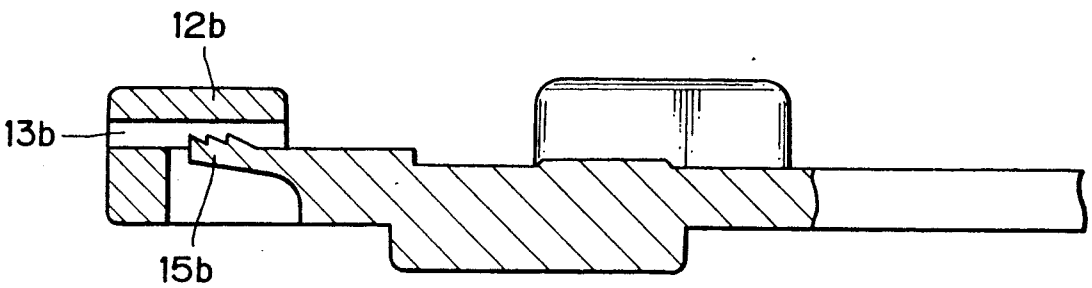
FIG. 4 is a longitudinal cross-sectional view of an upper plate of a sealing body of a security sealing mechanism according to a still another embodiment.

FIG. 4 shows still another embodiment of the present invention wherein, instead of on the upper edge of the tunnel 14, a resilient tongue 15 is provided on the lower edge of the tunnel 14 in such a manner to slant forwardly upwardly and is provided at its distal end on its upper surface with a series of teeth 16, which are engageable with the series of prongs 17 formed on the lower surface of the tail portion 11 when the tail portion 11 is inserted through the tunnel 14. The locking engagement between the teeth 16 and prongs 17 is effected immediately beneath the tail portion 11, being thus by far less accessible for unsealing by any tool from outside, thus rendering the security sealing mechanism S much safer.

It is to be noted that the pair of support walls 20, 20 can function to retain therebetween the pull tab P where it is directly attached to the attachment lug 18 of the slider 6 as efficiently as where the pull tab P is attached indirectly through the link 19 to the attachment lug 18 of the slider 6.

Figure 5:
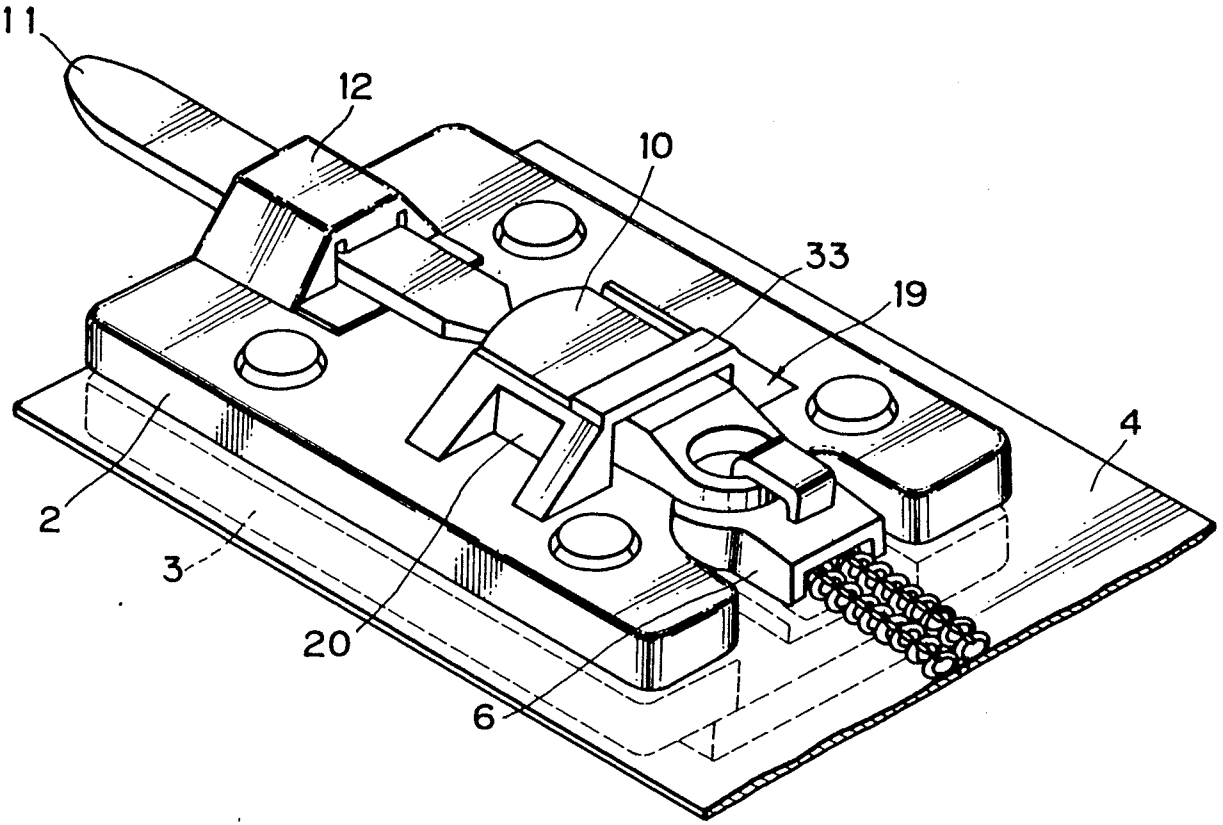
FIG. 5 is a view similar to FIG. 1 but shows a yet another embodiment.

FIG. 5 shows still another embodiment wherein a reinforcing bridge 33 join the support walls 20, 20 at their respective upper sides, to thus retain the pull tab body 10 between the support walls 20, 20 and the reinforcing bridge 33 against perpendicular displacement, thereby ensuring more secure sealing. Although the reinforcing bridge 33 are shown to joint the respective rear ends of the support walls 20, 20, the positions and the width of the reinforcing bridge 33 may be selected accordingly to meet the purpose. Instead of the single reinforcing bridge 33 extending over between the support walls 20, 20, a pair of overhangs (not shown) may extend from the support walls 20, 20 toward each other so as to retain the upper surface of the pull tab body 10.

Figure 6:
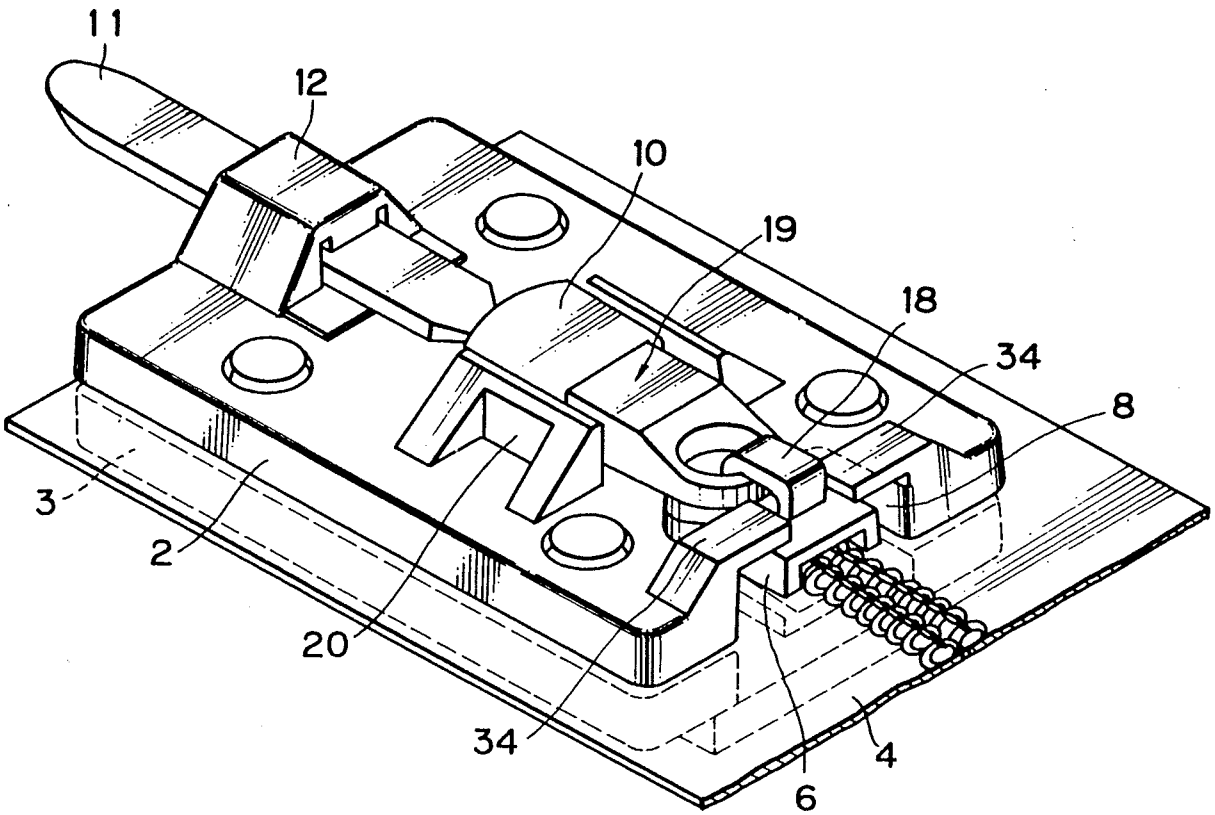
FIG. 6 is a view also similar to FIG. 1 but shows a yet another embodiment.

FIG. 6 shows a still another embodiment wherein a pair of brackets 34, 34 are provided on the opposite sides of the recess 8 in such a manner to extend towards to each other, but the respective tips of the brackets 34, 34 are separated by such a distance as to allow the attachment lug 18 of the slider 6 to fall in between the tips of the brackets 34, 34 when the front part of the slider 6 comes into abutting engagement with the concaved abutting surface 9. The brackets 34, 34 coact to retain the slider body 6' in stable posture against accidental perpendicular displacement of the slider 6, thus resulting in increased security in sealing. As set forth above, the reinforcing bridge 35 (FIG. 5) and the brackets 34, 34 (FIG. 6) retain the pull tab body 10 and the slider body 6', respectively, against accidental perpendicular displacement, thus not only resulting in increased security in sealing but also resulting in prevention of accidental breakage of the frangible thinned portion 21.

Figure 7A:
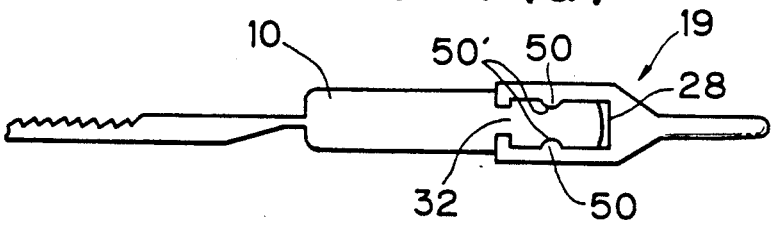
FIG. 7(*a*) is a fragmentary side elevational view of a pull tab and a link engaged with each other.
Figure 7B:
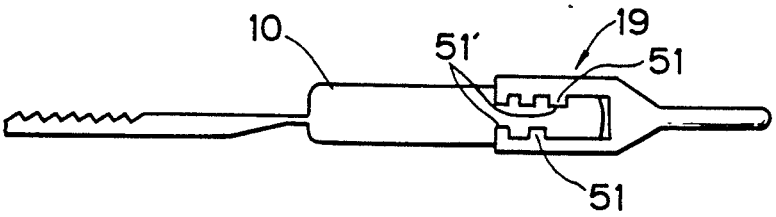

FIG. 7(*a*) and 7(*b*) shows a still another embodiment wherein the coupling flaps 28, 28 has a plurality of ridges 50, 51 formed on their respective inner opposed surfaces so as to extend longitudinally of the groove 27', while the fitting rim 29 has a plurality of gains 50', 51' formed in their opposed sides which gains are complementary in relative positions, size and shape with the ridges 50, 51. This arrangement ensures that the pull tab P equipped with the fitting rim 29 having the complementary gains 50', 51' are only available for coupling engagement with the link 19, so that the complementary ridges and gains 50, 51; 50', 51' function as identifying means to identify the pull tab 10. Consequently, it is ensured that, if someone else opens the bag 40 secretly in transit, he can never seal the bag 40 again unless he use a pull tab P equipped with the fitting rim 29 having the complementary gains 50', 51'. Various identifying means 50, 51, 50', 51' can be provided simply by changing the number, shape, size, relative positions etc. of the complementary ridges and gains 50, 51; 50', 51'.

Figure 8A:
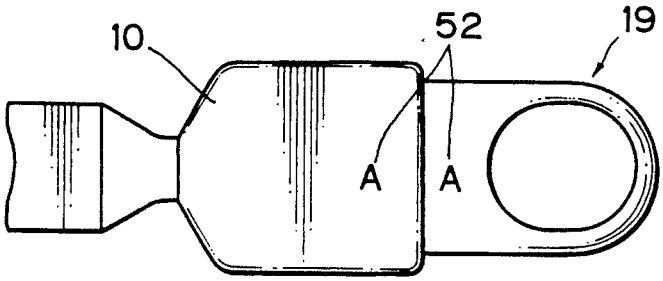
FIG. 8(*a*) is a fragmentary base view of a pull tab and a link engaged with each other.
Figure 8B:
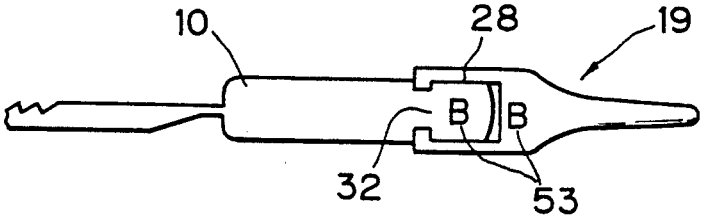

FIG. 8(*a*) and 8(*b*) shows still another embodiment in which, instead of the ridge and gain arrangement, marks 52, 53 are used as identifying means, that is, corresponding marks 52, 53 are depicted as by printing, stamping or otherwise on the lower surfaces of the pull tab body 10 and the link 19, respectively, which are out of sight or on the sides of the pull tab body 10 and the link 19, respectively, which are fully concealed by the support walls 20, 20. Alternatively, instead of both the pull tab body 10 and the link 19, only the pull tab 10 may be provided with the identifying mark as far as the user remembers the key mark. This helps the user of the bag 40 to check whether the bag 40 was open and re sealed in transit.

Obviously, various modifications and variations of the present invention are possible in the light of the above teaching. It is therefore to be understood that within the scope of the appended claims the invention may be practiced otherwise than as specifically described.

What is claimed is:

1. In a slide fastener comprising a pair of fastener stringers each including a fastener tape and a coupling element row mounted along the inner longitudinal edge thereof and a slider mounted reciprocatively on the coupling element rows, the slider including a slider body having an attachment lug mounted on the upper surface thereof and a link pivotally connected with the attachment lug; a security sealing mechanism comprising a sealing body mounted on that end of coupling element rows to which the slider comes for closing the slide fastener and including an abutting surface disposed at the end thereof contiguous to the coupling element rows for receiving the slider and locking means provided on the upper surface of the sealing body, and a pull tab having one end releasably jointed to the link and having the other end adapted for unreleasable locking engagement with the locking means.

2. A security sealing mechanism according to claim 1, the sealing body further including a pair of support walls mounted on the upper surface thereof and disposed in parallel spaced relation to each other to retain the pull tab therebetween.

3. In a slide fastener comprising a pair of fastener stringers each including a fastener tape and a coupling element row mounted along the inner longitudinal edge thereof and a slider mounted reciprocatively on the coupling element rows, the slider including a slider body having an attachment lug mounted on the upper surface thereof; a security sealing mechanism comprising a sealing body mounted at that end of coupling element rows to which the slider comes for closing the slide fastener and including an abutting surface disposed at the end thereof contiguous to the coupling element rows for receiving the slicer and locking means provided on the upper surface of the sealing body, and a pull tab having one end releasably jointed to the attachment lug and having the other end adapted for unreleasable locking engagement with the locking means, the sealing body further including a pair of support walls mounted on the upper surface of the sealing body and disposed in parallel spaced relation to each other to retain the pull tab therebetween.

4. A security sealing mechanism according to claim 2 or 3, the sealing body further including a reinforcing bridge joining the support walls at their respective upper sides.

5. A security sealing mechanism according to claim 4, the sealing body further including means for retaining the slider body when the slider comes into abutting engagement with the abutting surface.

6. A security sealing mechanism according to claim 5, the retaining means comprising a pair of brackets provided on the opposite sides of the abutting surface for jointly retaining the slider in stable posture against accidental perpendicular displacement.

7. A security sealing mechanism according to claim 1, the pull tab comprising a pull tab body releasably joined to the link, a tail portion adapted for unreleasably locking engagement with the locking means and a frangible thinned portion disposed between the pull tab body and the tail portion for facilitating intentional breakage of the pull tab therebetween.

8. A security sealing mechanism according to claim 3, the pull tab comprising a pull tab body releasably joined to the attachment lug, a tail portion adapted for unreleasably locking engagement with the locking means and a frangible thinned portion disposed between the pull tab body and the tail portion for facilitating intentional breakage of the pull tab therebetween.

9. A security sealing mechanism according to claim 7, the link comprising an annular portion and a coupling portion extending integrally from one end of the annular portion, the coupling portion being substantially of U-shaped cross-section and including a pair of parallel spaced coupling flaps defining therebetween a groove, the coupling flaps having a pair of coupling flanges, one on and along each of the front edges thereof, the pull tab body having at its distal end the fitting rim for fitting engagement with the coupling flaps of the link.

10. A security sealing mechanism according to claim 7 or 8, the locking means having a tunnel formed therethrough, and a resilient tongue provided protuberantly on the inner edge defining the tunnel, the resilient tongue being provided at its distal end and on its lower surface with a series of teeth; the tail portion of the pull tab being insertable through the tunnel and having at its middle on its upper surface with a series of prongs for locking engagement with the series of teeth of the resilient tongue.

11. A security sealing mechanism according to claim 10, the pull tab further including means for identifying the same.

12. A security sealing mechanism according to claim 11, the identifying means comprising a plurality of ridges provided on the respective inner opposed surfaces of the coupling flaps, and a plurality of gains formed in their opposed sides of the fitting rim and being complementary in relative positions, size and shape with the ridges.

13. A security sealing mechanism according to claim 11, the identifying means being a mark put on the pull tab.

14. A security sealing mechanism according to claim 13, the mark being put on the pull tab as hidden from the sight.

* * * * *